US007618287B2

(12) United States Patent
Hass

(10) Patent No.: US 7,618,287 B2
(45) Date of Patent: Nov. 17, 2009

(54) CONNECTING ARRANGEMENT AND CONTACT PIN

(75) Inventor: Juergen Hass, Erzhausen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 64 days.

(21) Appl. No.: 11/571,721

(22) PCT Filed: Jun. 21, 2005

(86) PCT No.: PCT/EP2005/006685

§ 371 (c)(1),
(2), (4) Date: Jan. 5, 2007

(87) PCT Pub. No.: WO2006/002803

PCT Pub. Date: Jan. 12, 2006

(65) Prior Publication Data

US 2008/0096421 A1 Apr. 24, 2008

(30) Foreign Application Priority Data

Jul. 5, 2004 (DE) ..... 10 2004 032 572

(51) Int. Cl.
*H01R 13/40* (2006.01)

(52) U.S. Cl. ..... 439/589; 439/272

(58) Field of Classification Search ..... 439/587, 439/588, 589, 597, 598, 599, 600, 751, 271–277
See application file for complete search history.

(56) References Cited

U.S. PATENT DOCUMENTS

| | | | | |
|---|---|---|---|---|
| 3,336,569 | A | 8/1967 | Nava | |
| 4,305,636 | A * | 12/1981 | Jackson et al. | 439/204 |
| 4,356,344 | A * | 10/1982 | Carey | 174/50.56 |
| 4,560,219 | A * | 12/1985 | Chapelot | 439/587 |
| 4,632,482 | A * | 12/1986 | Punako et al. | 439/587 |
| 5,115,563 | A | 5/1992 | Wilson et al. | |
| 5,496,193 | A * | 3/1996 | Kameyama | 439/589 |
| 5,571,032 | A | 11/1996 | Sano et al. | |

FOREIGN PATENT DOCUMENTS

| | | |
|---|---|---|
| EP | 0428259 A3 | 5/1991 |
| EP | 0700123 B1 | 3/1996 |

* cited by examiner

*Primary Examiner*—Ross N Gushi
(74) *Attorney, Agent, or Firm*—Barley Snyder LLC

(57) ABSTRACT

A connecting arrangement having a partition and a plurality of contact pins is disclosed. Each contact pin has two contact portions and a fastening portion electrically connecting the contact portions to each other, the contact portions each being arranged so as to be accessible from one side of the partition. The connecting arrangement also has a plurality of contact chambers into which the contact pins are arranged, a radially resilient sealing sleeve arranged in each contact chamber, and at least one seal. The seal is configured as a radially outwardly projecting circumferential annular web being arranged on the fastening portion of each contact pin and being sealingly pressed into the sealing sleeve.

31 Claims, 4 Drawing Sheets

CONNECTING ARRANGEMENT AND CONTACT PIN

CROSS-REFERENCE TO RELATED APPLICATIONS

This application is a National Stage Application filed under 35 U.S.C.§ 371 of PCT/EP 2005/006685 filed on Jun. 21, 2005, which claims priority of German Application No.: DE 10 2004 032 572.3, filed Jul. 5, 2004.

FIELD OF THE INVENTION

The invention relates to an electrical connector arrangement with a partition comprising a plurality of contact chambers, and with a plurality of contact pins arranged in the contact chambers, the pins each having two contact portions and a fastening portion electrically connecting the contact portions to each other, the contact portions each being arranged so as to be accessible from one side of the partition.

The invention also relates to a contact pin having two contact portions, via which an electrical connection can be produced between two electrical conductors separated from each other by a partition, and comprising a fastening portion via which the two contact portions are electrically connected to each other, the fastening portion being configured so it can be inserted into a contact chamber of the partition in a direction of insertion.

BACKGROUND

Connecting arrangements and contact pins of the aforementioned type are known from the prior art and are, for example, used in motor vehicle engineering. In this case an electrical signal is passed in or out through the contact pins or the connecting arrangement from a sealed region, such as a cylinder head or transmission, without leaks occurring and oil or a different fluid being able to escape through the contact chambers.

Because of stringent environmental protection directives in motor vehicle engineering, it must be ensured that engine and transmission oil can not pass into the environment at a cable bushing. Thus an electrical cable with a plurality of wires cannot be conveyed to the outside in a sealed cable bushing, as was previously conventional, as oil can pass to the outside between the outer cable insulation and the individual wires. While cables have been developed which are provided with a sealing material between the wires in order to prevent creepage of the oil within the cables, the production costs of these cables are so high that their use cannot be considered in large numbers in the automotive industry.

The use of these expensive cables is avoided by the device of U.S. Pat. No. 4,349,241. This document describes a plug-and-socket connector arrangement in which a connector and a mating connector are connected to each other in a fluid-tight manner. The connector comprises contact pins which are inserted into a contact chamber in a partition formed by the connector. The contact pins are held in the partition by a latching connection. A mating connector-side contact portion of the contact pin is configured as a pin, while another is configured as a lead clamp.

A further plug-and-socket connector arrangement is described in U.S. Pat. No. 4,820,204. In this plug-and-socket connector arrangement electrical conductors are connected to each other by a plurality of contact pins.

It is also known from the prior art to arrange the contact pin in a contact chamber so as to be electrically isolated, for example, in the cylinder head wall. The contact chamber is sealed by an O-ring and assembled in a corresponding seat between contact chamber and contact pin, so that no fluid can escape. A respective electrical cable is connected to the contact portion of the contact pin on either side of the partition, so that an electrical signal can be transmitted via the contact pin.

With the known contact pins and connecting arrangements, escape of oil or other fluids through the contact chamber is effectively prevented but in modern units, such as internal-combustion engines or transmissions, the number of signals to be transmitted has greatly increased. Thus ever more sensors are being used within the units and mechanical valve drives are being replaced by electromechanical ones. As a contact pin is required for each signal to be transmitted, and often only a small area is available for attaching the plug-and-socket connector, the spacing of the contact chambers has to be more and more reduced. This problem was previously solved in the prior art in that the smallest possible grid is produced between the contact pins, in which both the spacings between the contact chambers and the diameter of the contact pins have been reduced. The consequence of this is that a large number of O-rings have to be used, and these also have to be very small, assembly of which is difficult and time consuming.

An object of the present invention is to make possible a fluid-tight electrical connection with a high number of contacts per unit of area which can be assembled more easily and more quickly.

SUMMARY

The present invention relates to, in one embodiment among others, a connecting arrangement having a partition and a plurality of contact pins. Each contact pin has two contact portions and a fastening portion electrically connecting the contact portions to each other, the contact portions each being arranged so as to be accessible from one side of the partition. The connecting arrangement also has a plurality of contact chambers into which the contact pins are arranged, a radially resilient sealing sleeve arranged in each contact chamber, and at least one seal. The seal is configured as a radially outwardly projecting circumferential annular web being arranged on the fastening portion of each contact pin and being sealingly pressed into the sealing sleeve.

A connecting arrangement has contact chambers each having a radially resilient sealing sleeve and at least one seal configured as a radially outwardly projecting circumferential annular web which is arranged on the fastening portion of each contact pin and is pressed into the sealing sleeve in a fluid-tight manner.

The solution according to the invention is simple in terms of construction. The contact chamber is sealed without an O-ring having to be assembled. This has the advantage that assembly time and assembly costs are reduced. Manufacture of an O-ring seat in the contact chamber may, for example, also be dispensed with, whereby the manufacturing expenditure for the contact chamber is reduced.

A further advantage of the solution according to the invention is that the spacing or the grid between the plurality of contact pins in the partition can be reduced and the contact density thus increased as no space is provided for the O-ring seat and the diameter of the contact pin does not have to be adapted to the standardized diameter of the O-rings. As a result of the increased contact density of the connecting arrangement more electrical signals can be transmitted with the same size of connector.

The sealing sleeve is formed as a separate component inserted into the contact chamber and made of a radially resilient material or as a radially resilient region integral with the partition. With the integral formation, the partition and the sealing sleeve are, for example, produced in a two-component injection molding process in which firstly the material of the partition and then the material of the sealing sleeve is injected into the injection mold, the two materials being connected to each other with integral fit on solidification. In the configuration as a separate counterpart, the sealing sleeve is pressed into the contact chamber. In the process the sealing sleeve can, for example, be connected to the partition at the circumference by an adhesive.

As a result of the radially resilient sealing sleeve the tightness of the connecting arrangement according to the invention is particularly high. The internal diameter of the radially resilient sealing sleeve is smaller than the external diameter of the annular web so the annular web is pressed into the radially resilient sealing sleeve. A gasket compression is thus achieved which also seals the contact chamber against a pressurized fluid.

BRIEF DESCRIPTION OF THE DRAWINGS

The invention will be described hereinafter by way of example and with reference to the accompanying drawings of which: the different features can be combined independently of each other.

DETAILED DESCRIPTION OF THE EMBODIMENT(S)

Figure 1A:
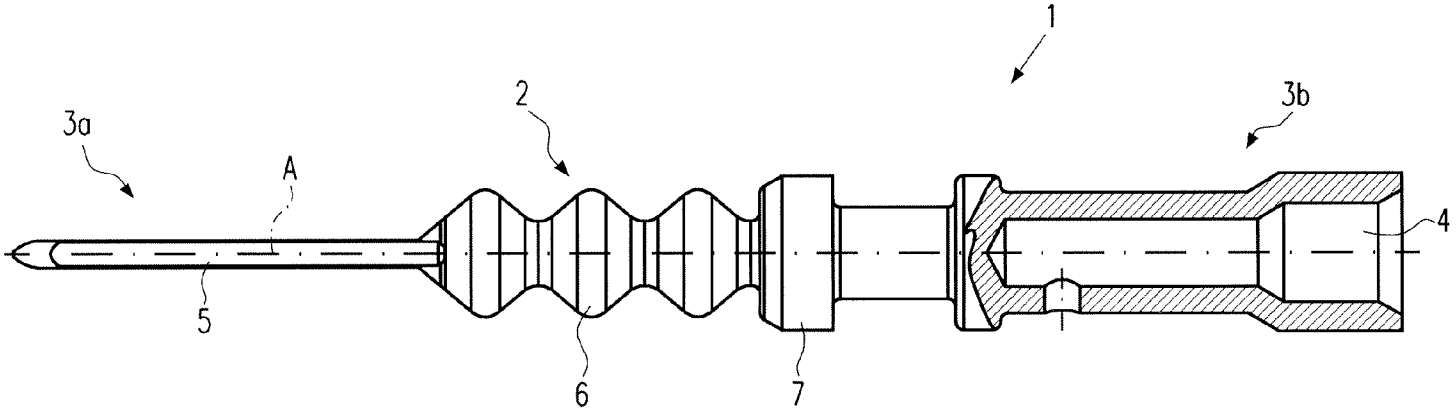
FIG. 1*a* is a side view, partially in section, of an exemplary embodiment of a contact pin according to the invention.

First, the general construction of a contact pin 1 according to the invention will be described by way of example with reference to the embodiment illustrated in FIG. 1*a*, 1*b* and 2.

The contact pin 1 comprises a fastening portion 2, a first contact portion 3*a* which is configured as a flat contact 5, a second contact portion 3*b* and a blind hole 4. The contact pin 1 can be connected with its two contact portions 3*a*, 3*b* to a respective electrical conductor (not shown). In this case, the first contact portion 3*a* is configured as a flat contact 5 with a cross-section that is rectangular in the axial direction. The contact pin 1 can be inserted, a direction of insertion E, with the flat contact 5, into a mating connector configured in a complementary manner as a bushing. An electrical conductor provided with a mating connector of this type can be connected particularly easily to the flat contact 5. Electrical signals can be transmitted from the contact pin 1 to the electrical conductor and vice versa as a result of the connected electrical conductor. To be able to transmit the electrical signals well, the contact pin 1 is produced from material that is particularly electrically conductive, for example from a conductive metal, or is coated with a conductive metal.

The second contact portion 3*b* is arranged on the trailing end of the contact pin 1. The blind hole 4 is used as a receiver for an electrical conductor. To connect the second contact portion 3*b* non-detachably to the conductor (not shown), a stripped end of the electrical conductor (not shown) is firstly pushed into the blind hole 4. The second contact portion 3*b* is then squeezed together, crimped, soldered or welded around the electrical conductor using a crimping tool. The electrical conductor is clamped in the blind hole 4 hereby and non-detachably electrically connected to the contact pin 1. Alternatively, the electrical conductor provided with a connector may also be inserted into the blind hole 4 in order to produce a repeatedly detachable plug-in connection between the contact pin 1 and the electrical conductor.

The fastening means portion 2 is formed on the contact pin 1 between the contact portions 3*a*, 3*b*. In the embodiment illustrated by way of example in FIG. 1*a*, the fastening portion 2 comprises a seal and optionally a holding member 7. The fastening portion comprises at least one sealing member configured as a circumferential annular web and which projects transversely to the direction of insertion and is configured so it can be brought into engagement with a sealing sleeve of the contact chamber in a radially resilient and fluid-tight manner.

The seal comprises one or more annular webs 6 which extend radially outwardly and over the entire circumference of the contact pin 1. As can be seen by way of example in FIG. 1*a*, at least two annular webs 6 can succeed each other in the axial direction. The seal 6 allows fluid-tight insertion of the contact pin 1 into a contact chamber 8 of a partition 9, as are shown by way of example in FIG. 2. The partition 9 can be part of a connector or a housing, for example of a unit. In this case the substantially cylindrical contact chamber 8 can be sealed in a fluid-tight manner in the axial direction by the at least two annular webs 6. The sealing effect is achieved, in particular, in that the webs 6 and the contact chamber 8 are radially resiliently engaged with each other. In the embodiment of FIG. 1*a* the maximum external diameter D of the annular webs 6 is for this purpose larger than the internal diameter I of the radially resilient contact chamber 8.

As the contact pin 1 in the embodiment illustrated by way of example is configured with at least two annular webs 6 arranged one after another, a redundant seal is created. If an annular web 6 does not completely seal the contact chamber 8, there are two further annular webs 6 to prevent leaks. The high tightness requirements of the automotive industry, for example, are also met thereby and leaks are prevented even in the event of high pressure differences on both sides of the partition 9.

The contact pin 1 according to the invention, the internal width of the seal in the direction transverse to the direction of insertion can be greater than the internal width of the, leading, contact portion 5. This has the advantage that the leading contact portion 5 of the contact pin 1 can be pushed through the contact chamber 8 without jamming on insertion. The at least one annular web 6 of the contact pin 1 can also be arc shaped in a longitudinal section through the contact pin 1, so, during insertion, the annular web 6 makes contact with the contact chamber 8 in a manner conducive to assembly and can thus be easily introduced.

The seal can be integrally formed together with the fastening portion on the contact pin so that the contact pin can be manufactured inexpensively. The contact pin 1 can in this case be produced from metal, for example by turning, punching, or injection molding.

Figure 2:
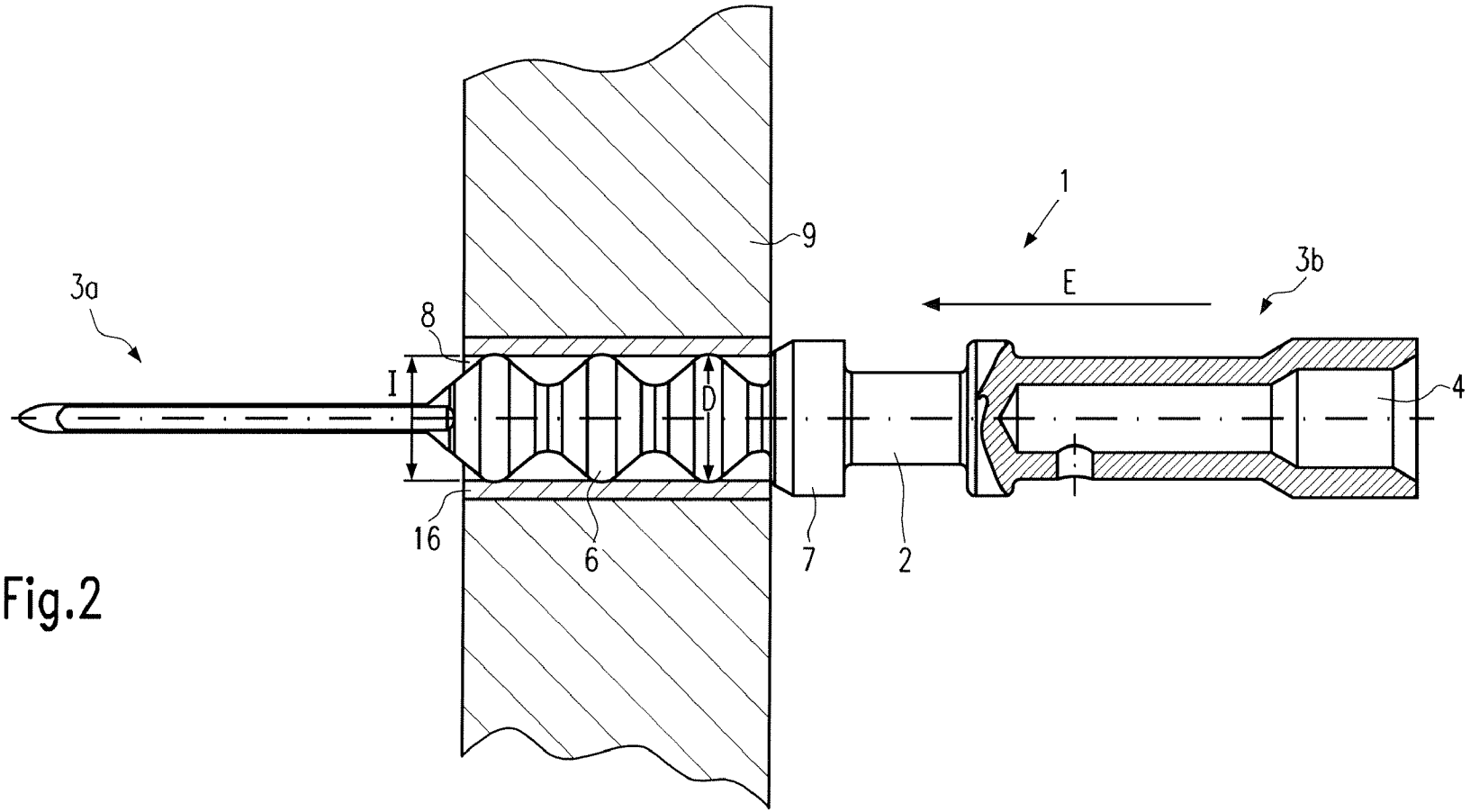
FIG. 2 is a side view of a first embodiment of a connecting arrangement according to the invention.

The contact pin 1 illustrated in FIG. 2 forms, with the partition 9, a first embodiment of a connecting arrangement 10 according to the invention.

The contact chamber 8 is provided with a radially resilient sealing sleeve 16. The annular webs 6 of the contact pin 1 are in radially elastic engagement with the sealing sleeve 16, whereby the contact chamber 8 is sealed. As the internal diameter I of the sealing sleeve 16 is smaller than the external diameter D of the annular webs 6, a partial gasket compression results which also seals the contact chamber 8 from more highly pressurized fluids. The sealing sleeve 16 is either configured as a separate part made of radially resilient material and inserted into the contact chamber 8 or is integrally formed with the partition 9. In the case of integral formation, the partition 9 and the sealing sleeve 16 are produced in a two-component injection molding process. In the process, first, the material of the partition 9 and then the material of the sealing sleeve 16 is injected into the injection. On curing, the two different materials form a connection with integral fit. In the configuration as a separate component, the sealing sleeve 16 is inserted into the contact chamber 8 and connected, for example by an adhesive, at the circumference to the partition 9. The length of the seal in the axial direction preferably corresponds substantially to the wall thickness of the partition 9, so that the sealing area is as large as possible.

The holding member 7 which, in the direction of insertion E, is arranged in the fastening portion 2 behind the annular webs 6, performs a dual function as a stop which limits the insertion depth of the contact pin 1 into the contact chamber 8. The holding member 7 thus prevents the first annular web 6 from projecting beyond the contact chamber 8, thereby failing to seal the contact chamber 8. In addition, the holding member 7 provided in the exemplary embodiment in FIG. 2 with a conical bevel closes the opening of the contact chamber 8 and forms a gap ring, so only a small amount of fluid can pass through the gap between the holding member 7 and the partition 9 past the holding member 7 and into the contact chamber 8. As can be seen in FIGS. 1*a*, 1*b* and 2, the holding member 7 likewise comprises an annular web, of which the diameter, however, is larger than the diameter of the annular webs 6 and the contact chamber 8.

Figure 1B:
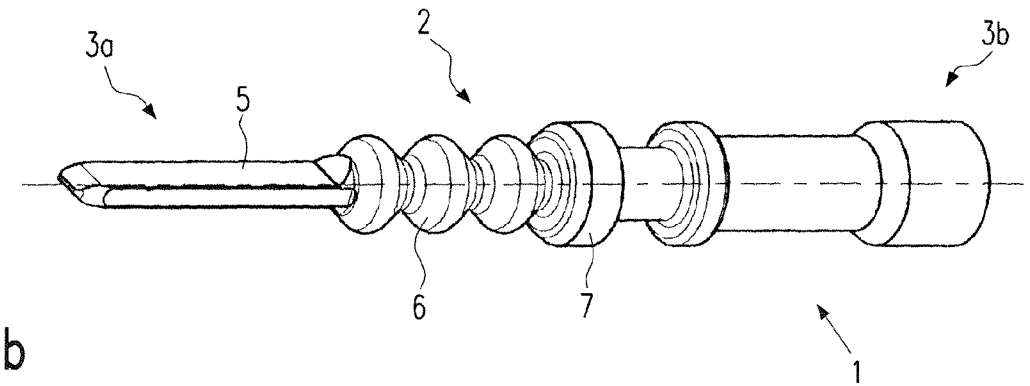
FIG. 1*b* is a perspective view of the contact pin of FIG. 1*a;*
Figure 3:
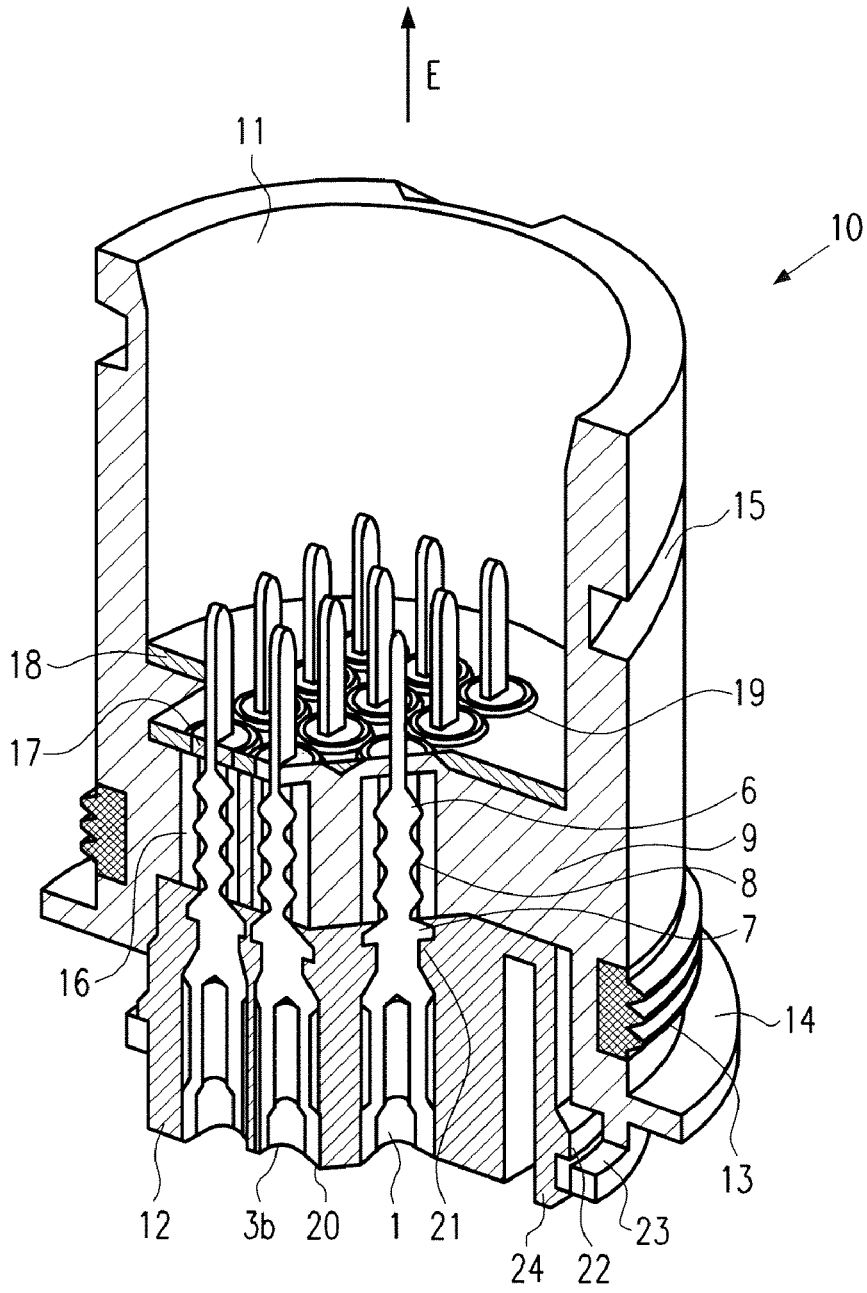
FIG. 3 is a perspective section of a further embodiment of the connecting arrangement according to the invention.

FIG. 3 shows a plurality of contact pins 1 according to the invention from FIGS. 1*a* and 1*b* as part of a further embodiment of the connecting arrangement 10 according to the invention. The connecting arrangement 10 comprises a plug-and-socket connector housing 11 with the partition 9, a receiving block 12 and a plurality of contact pins 1.

The plug-and-socket connector housing 11 is configured in the embodiment of the connecting arrangement 10 according to the invention illustrated by way of example in FIG. 3 as a cylindrical stopper with a circumferential seal 13, a flange 14 and a bayonet groove 15.

The connecting arrangement 10 can be inserted with the cylindrical plug-and-socket connector housing 11 into a cylindrical assembly opening (not shown). The assembly opening can, for example, be arranged in a cylinder head of an internal-combustion engine, a transmission housing or a tank. The diameter of the assembly corresponds in this case substantially to the external diameter of the plug-and-socket connector housing 11. The insertion depth of the plug-and-socket connector housing 11 in the assembly opening is limited in a direction of insertion E by the flange 14. The assembly opening is sealed in a fluid-tight manner by the circumferential seal 13 arranged on the external diameter of the plug-and-socket connector housing 11 and pressing with its sealing ribs on the internal wall of the assembly opening.

A corresponding bayonet pin (not shown), which, for example, is arranged on a cap nut or sleeve of a mating connector (not shown) can engage in the bayonet groove 15 formed on the circumference of the plug-and-socket connector housing 11. The plug-and-socket connector housing 11 can be fixed in the assembly opening and secured against falling out by screwing the cap nut.

The plug-and-socket connector housing 11 also comprises the partition 9 in which a plurality of contact chambers 8 is arranged. In this case the plug-and-socket connector housing and the partition wall can be integrally formed to reduce the manufacturing costs. A contact pin 1 is inserted into each contact chamber 8 in the direction of insertion E (cf. FIG. 1*a*). The contact chambers 8 of the partition 9 illustrated in FIG. 3 are each provided with a sealing sleeve 16. The annular webs 6 of each contact pin 1 are radially resiliently engaged with the sealing sleeves 16, so the contact chamber 8 is sealed. A partial gasket compression is produced at the location where the largest diameter of the annular webs 6 pushes into the sealing sleeve 16 which compression also seals the contact chamber 8 from more highly pressurized fluids.

The sealing sleeve 16 is, for example, produced from a radially resilient plastic material which is insensitive to aggressive media, such as oils, gasoline or diesel, and does not corrode. The substantially cylindrical sealing sleeve 16 can be inserted into the contact chambers 8 of the partition 9 and, for example, glued. During production of the plug-and-socket connector housing 11, the sealing sleeve 16 is preferably produced in a two-component process together with the partition 9. Complicated, time consuming assembly of the sealing sleeve 16 is thereby hereby.

Respective substantially disc-shaped aligning and centering masks 17 are arranged at the, end of the contact pin passages 8, through which masks 17 the one respective contact portion 3*a* is pushed. The masks 17 are provided with an opening, of which the contour corresponds to the cross-section of the contact portion 3*a*.

The contact pins 1 inserted into the contact chambers 8 are centered by the aligning and centering masks 17. The contact pins 1 arranged in the contact chambers 8 can be moved slightly radially in the flexible sealing sleeve 16. To prevent wobbling of the pointed flat contacts 5 of the contact pins 1, the flat contacts 5 are centrally fixed by the aligning and centering masks 17. During insertion in the direction of insertion E, the contact pins 1 are radially oriented through the aligning and masks 17. The aligning and masks 17 are formed such that the flat contacts 5 can only be inserted through them in a predetermined orientation. As the predetermined orientation is identical in all aligning and masks 17, all flat contacts 5 of the connecting arrangement 10 are aligned in the same direction. This is particularly important as otherwise a mating contact with bushings likewise aligned in a predetermined manner cannot be pushed onto the flat contacts 5 if the alignments of the bushings do not correspond with the alignment of the flat contact connector.

The aligning and masks 17 may be integrally formed with the partition 9 and the plug-and-socket connector housing 11. The aligning and masks 17 can be manufactured particularly inexpensively hereby and the plug-and-socket connector housing 11 can, for example, be produced as an injection molded part.

The plug-and-socket connector housing 11 also comprises on the, trailing side of the partition facing the mating connector, an axial seal 18 which seals the connecting arrangement 10 from a pushed-on mating connector. In addition, a concentric sealing ring 19, projecting in the direction of insertion E, is formed on the axial seal 18 around each flat contact 5. A bushing pushed onto a flat contact 5 presses against the sealing ring 19 and thus additionally seals each flat contact 5. Consequently, fluids are prevented from arriving at the flat contacts 5 and causing corrosion or a short circuit as a result. The axial seal 18 is configured so it can be resiliently compressed in the axial direction.

The axial seal 18, the sealing sleeve 16 and the circumferential seal 13 of the plug-and-socket connector housing 11 can be injected in one working step, and are preferably made from a different material to the connector housing 11, so the manufacturing costs may be reduced.

The receiving block 12 is arranged inserted in the plug-and-socket connector housing 11 at the leading side of the connecting arrangement 10. The receiving block 12 comprises a plurality of receiving apertures 20 with elastic latching tongues 21 and a connecting element 22.

The plug-and-socket connector housing can also form a receiver into which the receiving block can be inserted in the direction of insertion.

A respective contact pin 1 is inserted in the direction of insertion E in each receiving aperture 20 so as to be flush. The latching tongues 21 prevent the contact pins 1 from being able to be withdrawn from the receiving block 12 counter to the direction of insertion E. In the process, the latching tongues 21 each latch with the holding member 7 of the contact pins 1 in that the latching tongues 21 each engage behind the holding member 7.

The receiving block 12 is held on the plug-and-socket connector housing 11 by the wedge-shaped connecting element 22. The connecting element 22, which in the assembled state is engaged in a recess of the plug-and-socket connector housing 11, is arranged on a spring element 24 and can be moved radially inwardly to allow assembly and disassembly of the receiving block 12 with the plug-and-socket connector housing 11. The spring element 24 presses the connecting element 22 radially outwards so it engages independently in the recess 23.

During assembly of the connecting arrangement 10 according to the invention, the receiving block 12 is firstly inserted into the plug-and-socket connector housing 11 in the direction of insertion E. In the process the connecting element 22 engages in the recess 23 and fixes the receiving block 12 with respect to the plug-and-socket connector housing 11. The receiving block 12 is in the process aligned with respect to the plug-and-socket connector housing 11 such that the receiving apertures 20 align with the contact chambers 8. The contact pins 1 connected at their trailing contact portion 3*b* with a respective electrical conductor are inserted into the receiving apertures 20 next. The contact pins 1 are inserted into the receiving apertures 20 and the contact chambers 8 until the holding member 7 abuts the partition 9 and each contact pin 1 terminates flush with the receiving block 12. During insertion of the contact pins 1 the latching tongues 21 latch with the holding member 7 of the contact pins 1 and the contact pins 1 are thus secured against withdrawal counter to the direction of insertion E. Turning of the receiving block with respect to the partition and bending of the contact pins is prevented as a result of this measure. The thus preassembled connecting arrangement 10 can then be inserted into the assembly opening, for example of a cylinder head.

Figure 4:
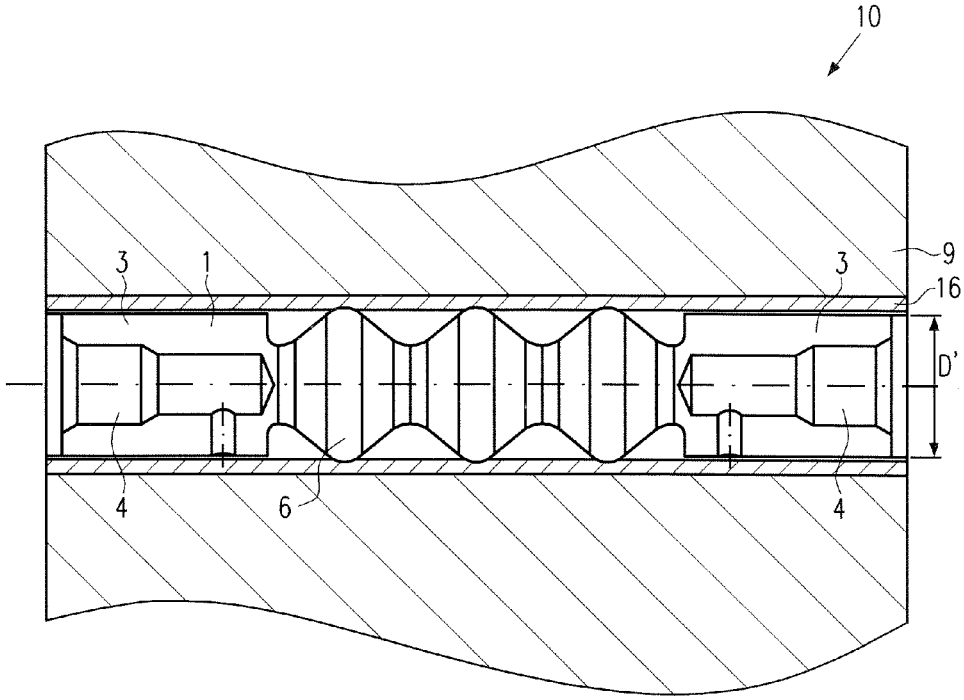
FIG. 4 is a partially sectioned view of a further embodiment of the connecting arrangement according to the invention.

FIG. 4 shows a further embodiment of the connecting arrangement 10 according to the invention. Only the differences from the previous embodiments will be discussed hereinafter.

In the connecting arrangement 10 illustrated by way of example in FIG. 4, the contact pin 1 has at its two contact portions 3, a respective blind hole 4 for receiving an electrical conductor. In this case, the contact pin 1 is connected to the electrical conductor in the same way as described above in the embodiment of FIG. 2. The configuration as a blind hole also ensures that a fluid which passes, for example, between the electrical conductor and its surrounding insulation into the blind hole, cannot pass through the hole to the other side of the partition.

In a manner different from that in the embodiment illustrated in FIG. 2 the contact chamber 8 is substantially longer than the contact pin 1, so the contact pin 1 is received in the contact chamber 8. The external diameter D' of the contact portions 3 is substantially equal here to the internal diameter 1 of the contact chamber 8, so the contact pin 1 can be inserted easily and in a guided manner into the contact chamber 8. As in the remaining embodiments the contact chamber 8 in FIG. 4 comprises a sealing sleeve 16 in which the annular webs 6 engage.

Of course further modifications to the illustrated contact pin 1 are also possible. Thus the contact pin 1 can be provided with pin contacts or flat plug contacts at both ends. The separate holding means can be omitted if the sealing means 6 provides an adequate holding force. In this case holding means 7 and sealing means 6 are identical.

To be able to use the contact pin 1 according to the invention in a connector-bushing connection, the contact pin 1 on one of the contact portions 3 can be configured as a flat contact 5 with, for example, a substantially rectangular cross-section. A mating connector with a correspondingly complementary socket contact can be pushed onto the flat contact 5, which can have standardized dimensions. The contact pin 5 can be configured on one of the contact portions but can also be configured as an annular contact that is circular in cross-section. Alternatively, the contact pin can also be formed on both contact portions as a flat and/or an annular contact or with a blind hole.

In an advantageous development a holding member can be formed on the fastening portion, which means, in a direction of insertion, is preferably arranged behind the seal. The holding member can, in particular, form a stop, of which the diameter corresponds at least to the diameter of the annular web 6. The insertion depth of the contact pin 1 in the contact chamber 8 is limited by the stop, and the position of the contact pin 5 in the partition wall 9 is determined in that the stop is pushed against a counterstop formed by the contact chamber 8. To seal the contact pin 1 from the contact chamber 8 even more securely, the holding member can be configured as an additional seal. For example, the stop can be constructed as an annular web which rests on the contact chamber 8 while forming a gap ring. In an advantageous development the holding member can comprise at least two annular webs that are spaced apart in the axial direction and between which an annular groove is formed. The annular groove can be used as part of a latching means in that a latching tongue projects into the annular groove and presses against the stop located in the direction of insertion. This thus prevents the possibility of the contact pin being pulled from the contact chamber counter to the direction of insertion.

The invention claimed is:

1. A connecting arrangement comprising:

a partition;

a plurality of contact pins each having two contact portions and a fastening portion electrically connecting the contact portions to each other, the contact portions each being arranged so as to be accessible from one side of the partition;

a plurality of contact chambers into which the contact pins are arranged;

a radially resilient sealing sleeve arranged in each contact chamber;

at least one seal, configured as a radially outwardly projecting circumferential annular web being arranged on the fastening portion of each contact pin and being sealingly pressed into the sealing sleeve; and a receiving block in which a plurality of receiving apertures aligned with the contact chambers are configured for receiving the contact pin.

2. The connecting arrangement according to claim 1, wherein the fastening portion is provided with a holding member by which the contact pin is non-displaceably held.

3. The connecting arrangement according to claim 1, wherein the internal width of the seal is greater in the direction transverse to the longitudinal axis than the diameter of the contact chambers.

4. The connecting arrangement according to claim 1, wherein a respective aligning and centering mask that radially centers the contact pin is arranged at one end of the contact chambers.

5. The connecting arrangement according to claim 4, wherein the aligning and centering mask is integrally formed with the partition.

6. The connecting arrangement according to claim 1, wherein the receiving block comprises latching tongues which axially fix the contact pin in the receiving apertures, counter to the direction of insertion.

7. The connecting arrangement according to claim 1, wherein the receiving block comprises at least one connecting element by which the receiving block is fixed securely in position with respect to the partition.

8. The connecting arrangement according to claim 1, further comprising:

a plug-and-socket connector housing forming the partition and by means of which the connecting arrangement is configured so as to be insertable into an assembly opening.

9. The connecting arrangement according to claim 8, wherein the plug-and-socket connector housing is configured with a circumferential seal via which the plug-and-socket connector housing can be arranged in the assembly opening in a fluid-tight manner.

10. The connecting arrangement according to claim 9, further comprising:

an axial seal on the housing, configured to, seal with a mating connector in a fluid-tight manner.

11. The connecting arrangement according to claim 10, further comprising:

a sealing ring, projecting in the direction of insertion, arranged on the axial seal concentrically around the contact chambers.

12. A contact pin and sleeve arrangement, comprising:

a tubular member having an internal diameter and forming the sleeve;

two contact portions on the pin via which an electrical connection can be produced between two electrical conductors separated from each other by a partition, and comprising a fastening portion via which the two contact portions are electrically conductively connected to each other, the fastening portion being configured to be inserted into the tubular member, the tubular member fittable into a contact chamber of the partition in a direction of insertion, wherein the fastening portion comprises at least one sealing means configured as a plurality of circumferential annular webs that projects transversely to the direction of insertion and is configured to be insertable into the tubular member of the contact chamber in the direction of insertion, the plurality of circumferential annular webs being engageable with the tubular member sealing sleeve of the contact chamber in a radially resilient and fluid-tight manner;

wherein the fastening portion is provided with an integral holding means via which the contact pin can be fixed in the contact chamber, the holding means is a holding member arranged behind the annular webs in the direction of insertion and partially insertable into the tubular member, a portion of the holding member being larger in diameter than the internal diameter of the tubular member.

13. The contact pin according to claim 12, wherein the internal width of the sealing means is greater in the direction transverse to the direction of insertion than the internal width of the contact portion at the front in the direction of insertion.

14. The contact pin according to claim 12, wherein the at least one sealing means is integrally formed on the contact pin.

15. The contact pin according to claim 12, wherein the at least one annular web is arc shaped in a longitudinal section.

16. The contact pin according to claim 12, wherein at least one of the contact portions is configured with an axial blind hole into which one electrical conductor can be inserted or crimped.

17. The contact pin according to claim 12, wherein at least one of the contact portions is configured as a rectangular flat contact.

18. The contact pin according to claim 12, wherein at least one of the contact portions is configured as a circular annular contact.

19. The contact pin according to claim 12, wherein, in the direction of insertion, the holding means is arranged behind the at least one annular web thus limiting the insertion depth of the contact pin into the contact chamber.

20. The contact pin according to claim 12, wherein the fastening portion comprises at least two annular webs that are axially spaced apart, the axial center spacing of the annular webs being smaller than the axial length of the contact chamber.

21. The contact pin of claim 12, wherein the fastening portion closes the back of contact chamber.

22. The contact pin of claim 21, wherein the holding member comprises an annular web having a diameter that is larger than the diameter of the annular webs and the contact chamber.

23. The contact pin of claim 22, wherein the holding member is configured as an additional seal in order to seal the contact pin from the contact chamber.

24. The contact pin of claim 23, wherein the holding member is configured with a conical bevel that closes an opening of the contact chamber.

25. A connecting arrangement comprising:

a partition;

a plurality of contact pins each having two contact portions and a fastening portion electrically connecting the contact portions to each other, the contact portions each being arranged so as to be accessible from one side of the partition;

a plurality of contact chambers into which the contact pins are arranged;

a radially resilient sealing sleeve being integrally formed with each contact chamber; and at least one seal, configured as a radially outwardly projecting circumferential annular web being arranged on the fastening portion of each contact pin and being sealingly pressed into the sealing sleeve.

26. The connecting arrangement according to claim 25, wherein the fastening portion is provided with a holding member by which the contact pin is non-displaceably held.

27. The connecting arrangement according to claim 25, wherein the internal width of the seal is greater in the direction transverse to the longitudinal axis than the diameter of the contact chambers.

28. The connecting arrangement according to claim 25, wherein a respective aligning and centering mask that radially centers the contact pin is arranged at one end of the contact chambers.

29. The connecting arrangement according to claim 28, wherein the aligning and centering mask is integrally formed with the partition.

30. The connecting arrangement according to claim 25, further comprising a receiving block having latching tongues which axially fix the contact pins in the contact chambers.

31. The connecting arrangement according to claim 30, wherein the receiving block comprises at least one connecting element by which the receiving block is fixed securely in position with respect to the partition.

* * * * *